US006428595B1

(12) United States Patent
Hayashi et al.

(10) Patent No.: US 6,428,595 B1
(45) Date of Patent: Aug. 6, 2002

(54) METAL SINTERE BODY AND PRODUCTION METHOD THEREOF

(75) Inventors: Junichi Hayashi, Okaya; Masaaki Sakata, Suwa, both of (JP)

(73) Assignee: Injex Corporation (JP)

( * ) Notice: Subject to any disclaimer, the term of this patent is extended or adjusted under 35 U.S.C. 154(b) by 0 days.

(21) Appl. No.: 09/554,694

(22) PCT Filed: Sep. 13, 1999

(86) PCT No.: PCT/JP99/04999

§ 371 (c)(1),
(2), (4) Date: May 17, 2000

(87) PCT Pub. No.: WO00/16936

PCT Pub. Date: Mar. 30, 2000

(30) Foreign Application Priority Data

Sep. 18, 1998 (JP) ..... 10-265402

(51) Int. Cl.[7] ..... B22B 3/12
(52) U.S. Cl. ..... 75/246; 419/36; 419/38
(58) Field of Search ..... 419/36, 38; 75/246

(56) References Cited

U.S. PATENT DOCUMENTS 3,809,553 A 5/1974 Peaslee
4,608,317 A * 8/1986 Kobayashi et al. ..... 428/546
5,135,712 A * 8/1992 Kijima et al. ..... 419/36
5,989,493 A * 11/1999 La Salle et al. ..... 419/36

FOREIGN PATENT DOCUMENTS

EP 0 379 777 A1 * 8/1989
EP 0 437 851 A2 * 12/1990
JP 5-43911 2/1993
JP 8-260005 10/1996

OTHER PUBLICATIONS

Taiwanese Office Action with Reference cited (Journal of Powder Metallurgy Society), English translation of Taiwanese Office Action and referenced document.
Patent Abstracts of Japan; Pub. No. 60089504; Pub. Date–May 20, 1985; Applicant–Toshiba Mach Co., Ltd.; Inventor–Takahashi Sakae; Title–"Coating Method of Wear Resistant Composite Material".
Document No. XP–002177138; Abstract of J 60089503, Coating of Wear–Resistant material; Toshiba Machine Co., Ltd.; May 20, 1985.

* cited by examiner

*Primary Examiner*—Ngoclan Mai
(74) *Attorney, Agent, or Firm*—Harness, Dickey & Pierce, P.L.C.

(57) ABSTRACT

A metal sintered part; the subject of this invention is produced by the following example processes in order to offer the metal sintered part, which has a high degree of hardness and a superior wear resistance, and, in order to offer the uncomplicated production method.

Process 1A: To produce a green body, which is manufactured from a metal powder and a binding material, by the metal injection molding (MIM) method.

Process 2A: To conduct the de-binding treatment to the green body.

Process 3A: To sinter the de-binding body and obtain the metal sintered part.

The metal powder for the production is a self-fluxing alloy, such as a nickel based self-fluxing alloy. The surface Vickers hardness Hv of this product is more than value 500.

9 Claims, 2 Drawing Sheets

METAL SINTERE BODY AND PRODUCTION METHOD THEREOF

TECHNOLOGY FIELD

This invention relates to a metal sintered part, which is obtained from sintering metal powder and its production method.

PRIOR ART TECHNOLOGY

The following method, referred to as tape automatic bonding (TAB), is utilized in semiconductor mounting technology. (i) Semiconductor chips are fixed on the carrier tape (long length film). They are placed at regular intervals along the edge side of the tape. (ii) The tape is traveled, and these semiconductor chips are conveyed in the manufacturing process. Simultaneously, wire bonding or similar bonding methods are utilized for each semiconductor chip.

This carrier tape is given momentum by the following process. (1) The wheel tooth of a sprocket gear engages with an aperture, which is created along the edges of the tape. (2) The turning sprocket gear moves the long length film. This sprocket gear has a ratchet gear, which (a) turns toward one direction, and (b) has multiple ratchet teeth in order to control the spinning amount (feeding amount).

These sprocket gear and ratchet gear are produced by a presswork method as separate framework components. Then, both frameworks are positioned and bound together with caulking. However, there are the following various deficiencies.

1) Many components are necessary, so the component logistical administration is complicated. Concurrent with this, the construction process is comprehensive.

2) For proper positioning, a concave part and a convex part are needed for the sprocket gear and the ratchet gear, in order to fit or inter-connect with each other, making the component configuration complicated.

3) Because of the low durability of the caulking (binding) parts and for other reasons, the reliability of the components cannot be maintained for a long term.

4) Ratchet teeth are easily worn out on the ratchet gear, so that a high degree of hardness (wear resistance) is required for the material quality. Therefore, a hardening process (using SK-4 material) is used for the produced ratchet gear. However, the hardening process causes distortion, causing a dimensional or tolerance error. In order to produce the ratchet gear within specifications, a subsequence process, such as grinding or similar process, is required after hardening. However, this results in an increase in the number of process stages and an increase in production cost.

Because of these defects and impediments, a new invention has been created. The objective of this invention is to offer a metal sintered part with the following characteristics and a production method which has:

(a) a high degree of hardness, and (b) a superior wear resistance and (c) an uncomplicated production method.

INVENTION DISCLOSURE

1. A metal sintered part wherein the part is produced by de-binding and sintering a green body, which includes a metal powder and binding material. The above-mentioned metal powder is comprised of a self-fluxing alloy.
2. It is preferable that the above-mentioned self-fluxing alloy be a nickel radical self-fluxing alloy.
3. It is preferable that the above-mentioned green body be produced by using a metal powder injection molding method.
4. It is preferable that the content amount of the metal powder in the above-mentioned green body be between 80 and 98 wt %.
5. It is preferable that the Vickers hardness Hv on the surface of the above-mentioned metal sintered part be more than a value of 500.
6. It is preferable that the tensile strength of the above-mentioned metal sintered part be between 10 and 60 $kg/mm^2$.
7. It is preferable that the metal sintered part have a portion designed for high wear durability.
8. It is preferable that the above-mentioned metal sintered part be a component within a power transmission.
9. It is preferable that the above-mentioned metal sintered part engage a first driveline (sprocket gear) and a second driveline (ratchet gear) in the power transmission component.
10. A production method of the metal sintered part wherein it includes the following three processes. (i) To produce a green body, which includes a metal powder and a binding material. The metal powder is comprised of self-fluxing alloy. (ii) To conduct a de-binding treatment on the obtained green body. (iii) To sinter the obtained de-binding part; then, to produce a metal sintered part.
11. It is preferable that the above-mentioned self-fluxing alloy be a nickel based self-fluxing alloy.
12. It is preferable that the production of the above-mentioned green body be conducted by using the metal powder injection molding method.
13. It is preferable that the content amount of the above-mentioned metal powder in the green body be between 80 and 98 wt %.

| Symbol explanation: | |
|---|---|
| 1: | Metal sintered part |
| 2: | Sprocket gear |
| 21: | Jut |
| 3: | Ratchet gear |
| 31: | Ratchet tooth |
| 4: | Opening |
| 1A: | Production process for green body |
| 2A: | De-binding treatment process |
| 3A: | Sintering process |

PRIME PATTERN FOR IMPLEMENTING THE INVENTION

Figure 1:
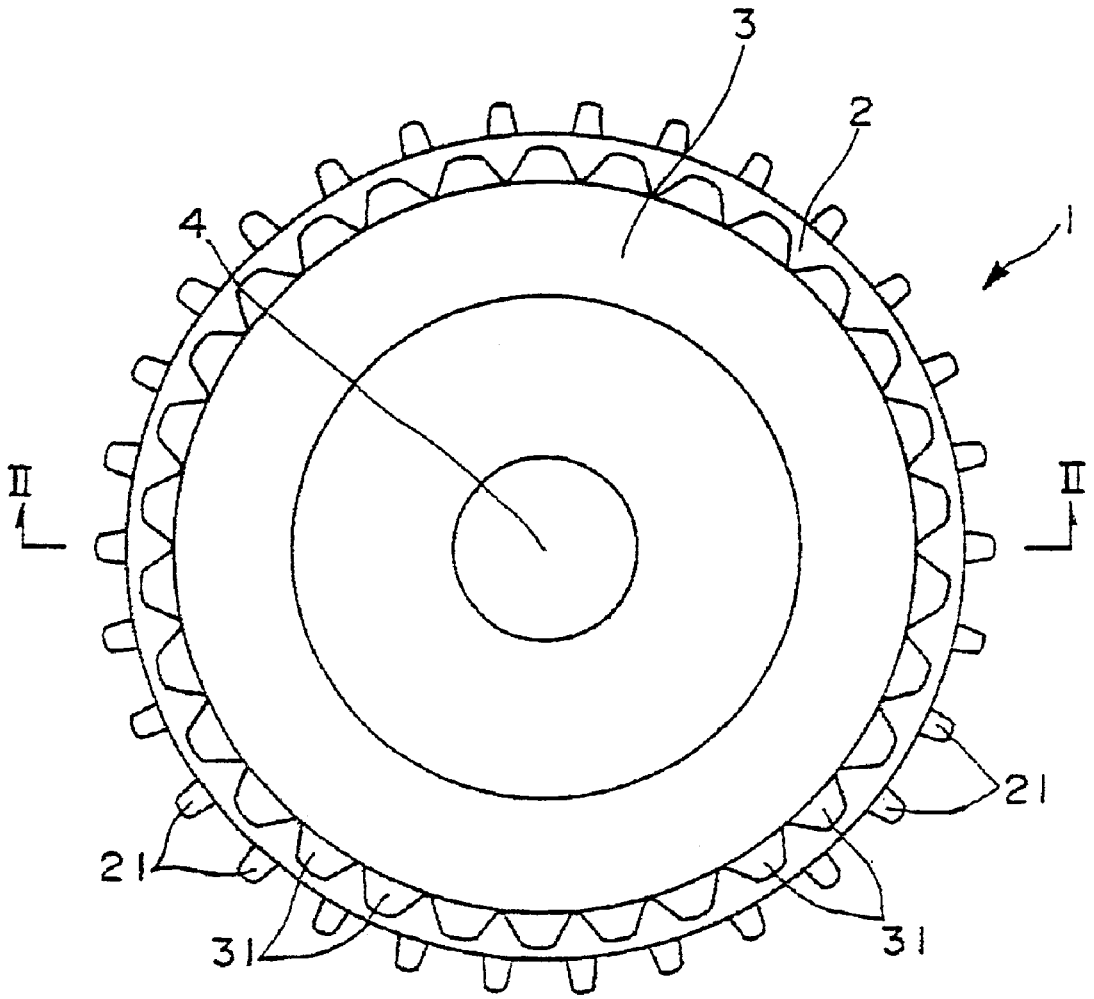
FIG. 1 illustrates an outline of the implementation of the metal sintered part relating to this invention.
Figure 2:
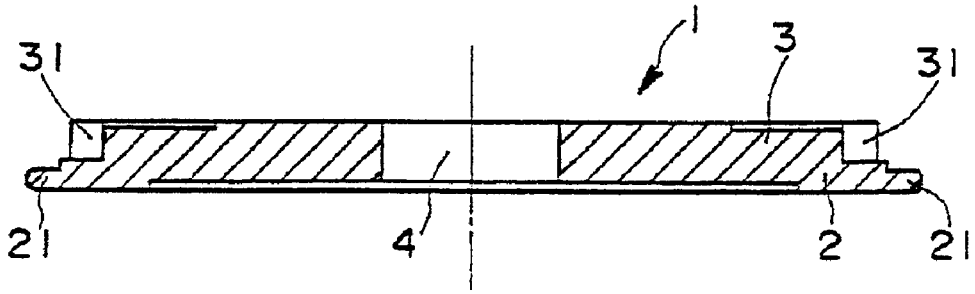
FIG. 2 is a sectional drawing of II—II line in FIG. 1.
Figure 3:
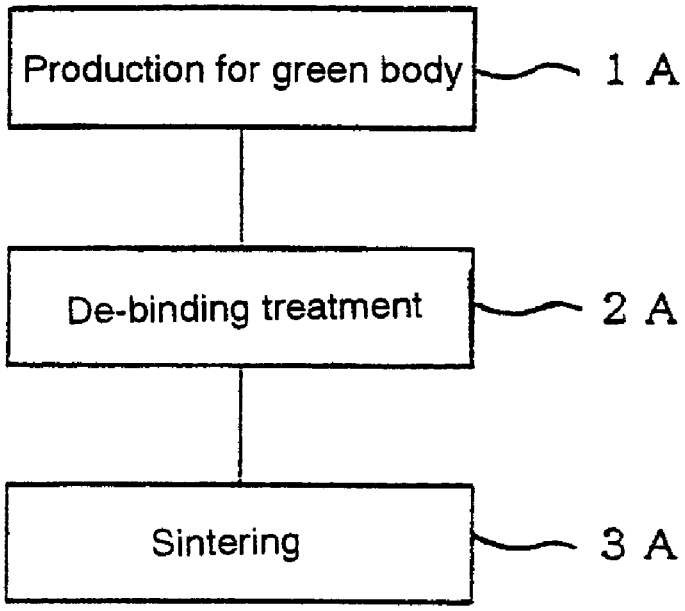
FIG. 3 indicates a process chart of the implementation of the production method of the metal sintered part relating to this invention.

Next, the metal sintered part and the production method are explained in detail. FIG. 1 illustrates an outline of the implementation of the metal sintered part of this invention. FIG. 2 is a sectional drawing of II—II line in FIG. 1. FIG. 3 indicates a process chart of the implementation of the production method of the metal sintered part of this invention.

First, the construction of the metal sintered part of this invention, which is illustrated in FIG. 1, is explained. The metal sintered part 1 illustrated in the drawing, is a component in an assembly used to drive a carrier tape associated with semiconductor chip manufacturing during the above-mentioned TAB method. This metal sintered part 1 is a power transmission component, which is produced by integrating the sprocket gear (the first power transmission section) 2 and the ratchet gear (the second power transmission section) 3.

The sprocket gear 2 and the ratchet gear 3 are placed concentrically. The circular opening 4 is created at the center part in order to insert the rotating power shaft. The diameter of the sprocket gear 2, which is shown at the lower end of FIG. 2, is larger than the diameter of the ratchet gear 3.

Multiple juts 21 are created at regular intervals in the periphery of the sprocket gear 2. Each jut 21 is created on the sprocket gear 2, and is integrated with the gear 2. These juts 21 are inserted into the aperture, which is created at both side edges of the above-mentioned carrier tape (not drawn).

The multiple ratchet teeth (wear part) 31 are created at regular intervals in the periphery of the ratchet gear 3. Each ratchet tooth 31 is created on the ratchet gear 3 and is integrated with the gear 3. These ratchet teeth 31 have a relationship with ratchet nails (not drawn), and they drive the ratchet gear 3 by spinning in a specified direction with the specified revolutions per minute (feeding amount). The spinning energy of the ratchet gear 3 is transmitted to the sprocket gear 2, which is integrated with the ratchet gear 3.

Then, the above-mentioned carrier tape can be thrust in a relationship with the juts 21. The created number of the ratchet teeth 31 is the same as the number of juts 21. The ratchet teeth 31 are located inside of the periphery of the sprocket gear 2, and are deviated one-half pitch from the juts 21.

The metal sintered part 1 is characterized by the following conditions and factors.

Each jut 21 of the sprocket gear 2 is in a relationship with the carrier tape; which tape has flexibility. The torque of the sprocket gear 2, which is necessary in order to convey the carrier tape, may be relatively small. Therefore, the mechanical strength of the sprocket gear 2 including the juts 21 is relatively low.

A large torque does not affect the ratchet gear 3 the same as the sprocket gear 2, so that the mechanical strength of the ratchet gear 3 may be comparatively low. However, the ratchet teeth 31 of the ratchet gear 3 requires wear resistance because of the frequent grinding action of the ratchet nails. Therefore, a higher degree of hardness is required.

The metal sintered part is produced by de-binding and sintering a green body, which includes a metal powder and a binding material. The above-mentioned metal powder is comprised of a self-fluxing alloy. The details of these compositions will be described below in the section of the production method for the metal sintered part.

An example of the production method for the metal sintered part is explained hereafter, with reference to FIG. 3. The metal sintered part 1 is produced according to the processes in the below-mentioned manufacturing stages [1A]–[3A].

[1A] Production of a Green Body

A green body, which has a shape equivalent to the produced metal sintered part 1, is produced. The production method of the green body is not limited, so that the usual pressing powder method or similar method is efficient. The green body, which is produced by the MIM (Metal Injection Molding) method, is preferable.

This metal injection molding method can produce a metal sintered part, which is of relative small size, and which has a complicated minute configuration. The method fully uses the characteristics of the metal powder, so that the bonding effect is exhibited effectively. This is the preferable method for manufacturing the green body.

Next, the preparation of molding materials and the production of the green body by the MIM method are explained.

First, a metal powder and a binding material (organic binder) are prepared. A mixing machine mixes the materials; then, a feed stock is created.

The metal material, which comprises the metal powder, is a self-fluxing alloy. The self-fluxing alloy is mainly used for flame spray coating in the industrial field, such as nickel based self-fluxing alloy, cobalt based self-fluxing alloy, and tungsten carbide self-fluxing alloy.

An example of the composition is indicated in the following Table 1.

For the following reasons, the nickel radical self-fluxing based is preferable: (a) sufficient degree of hardness (wear resisting characteristic), (b) high sintering characteristic, and (c) relatively modest price.

One or more kinds of the following elements can be included in the self-fluxing alloy, other than the elements indicated in Table 1: Mn, Zn, Sn, Pb, Pt, Au, Ag, Pd, Al, Ti, V, Nb, Ga, Ta, Zr, Pr, Nd, Sm, Y, P, S, and O.

The average particle diameter is not critical and thus is not limited. However, less than 150 $\mu$m is acceptable; and normally 0.1–60 $\mu$m is preferable. When the average particle diameter is too large, the sintering performance may become less efficient, depending upon the other conditions.

The production method of the metal powder is not limited. For example, an implementation that is produced by a water/gas atomizing method or a pulverization method, can be used.

The binding material (binder) relies upon the following: polyethylene, polypropylene, polyolefin (such as, ethylene vinyl acetate copolymer), acrylic resin (such as polymethyl methacrylate, and polybutyl methacrylate), styrene resin (such as polystyrene), polychloroethene, polychlorovinylidene, polyamide, polyester, polyether, polyvinyl alcohol, various kinds of copolymer of these chemicals, various kinds of waxes, paraffin, fatty acids (such as, stearic acid), higher alcohol, fatty acid ester, and fatty acid amide. These material ingredients can be used singularly or in two or more combinations.

A plasticizer may be added into the feed stock. The platicizer examples are the following: phthalate (such as, DOP: dioctyl phthalate, DEP: diethyl phthalate, DBP: dibutyl phthalate), adipate, trimellitic, and sebacate. These material ingredients can be used singular or in two or more combinations.

When mixing as mentioned above, other than the above-mentioned metal powder, the binding material and the plasticizer, various additives, such as a lubricating preparation, an oxidation inhibitor, a de-binding accelerator, or a surfactant, can be added, if necessary.

The mixing variables are differentiated upon the composition & the particle diameter of the metal powder, the composition & the amount of the binding materials, and any additives. An example of one condition is: (a) mixing temperature: 20–200° C., and (b) mixing time: 20–210 minutes. Sufficient mixing procedure results in an even scattering of the metal powder in the subject green body. In other words, the density becomes more uniform. As a result, a high quality metal sintered part, without a molding deficiency and a sintering deficiency, will be obtained.

The feed stock will be pelletized (being nubbly), if necessary. The particle diameter of the pellet is established within the parameter of: 1–10 mm.

Next, the obtained feed stock or the granulated pellets from the subject feed stock are injection-molded by the injection molding machine. The green body with the desired configuration and dimensions is produced. In this case, a green body with a complicated minute shape can be easily produced with the selection of mold pattern.

The molding conditions relevant to the metal injection molding method differentiate upon the metal composition & the ingredient particle diameter of the subject metal powder, and the composition & the amount of the binding materials. The subject example has the following condition variables: (a) preferable material temperature: 20–230° C., and (b) preferable injection pressure: 30–170 kgf/cm$^2$.

The content amount of the metal powder in the green body does not have specific limitations; however, 80–98 wt % is acceptable, and 85–96 wt % is preferable. If the content amount of the metal powder is too low, the contraction factor becomes too large when de-binding and sintering the green body. The dimensional accuracy of the subject metal sintered part can diminish. Further, if the content amount of the metal powder is too high, the mobility of the molding material becomes low when injection molding by the metal injection mold method. Then, molding performance becomes lower.

Shape and the size of the manufactured green body are decided in expectation of the amount of the shrinkage of the green body caused by the de-binding and the sintering.

[2A] De-binding Treatment for the Green Body

The de-binding treatment is given to the subject green body, which is obtained in the above-mentioned process [1A].

A thermal treatment is conducted under a non-oxygen atmosphere, such as in vacuum or under the reduced pressure ($1\times10^{-1}$–$1\times10^{-6}$ Torr), in an inert gas (such as nitrogen gas or argon gas).

In this case, as the condition for the thermal treatment, it is acceptable that the temperature range is 150–750° C. and that the duration is 0.2–40 hours. It is preferable that the temperature is within 250–650° C. and that the duration is within 0.5–18 hours.

The de-binding by the thermal treatment may be divided into multiple processes (stages) governed by various purposes (such as, a purpose to reduce the de-binding time). In this case, for example,-the following methods are presented. (a) The de-binding treatment is accomplished at a low temperature in the first half period, and at a high temperature in the second half period. (b) The method can be modified to cycle between the influences of alternating lower temperature and then, higher temperature. This de-binding treatment may be given by eluting the specific ingredients in the binding material(s) or the additives in the solvent.

As described above, the density of the green body is uniform, so that, the de-binding of the green body is evenly conducted when utilizing this de-binding treatment. Therefore, a deformation of the green body is prevented, and precise dimension accuracy is obtained.

[3A] Sintering

The obtained sintered part is burned in the sintering furnace and sintered, thereby producing the metal sintered part 1.

The metal powder diffuses under heat and the particles form in crystal-like particles by this sintering process, thereby obaining the over-all minute metal sintered part. In other words, this part has high density and low vacancy ratio.

The temperature for sintering the subject green body is not limited. However, when the metallic composition of the metal powder is a nickel based self-fluxing alloy, the acceptable temperature range is 850–1350° C., and the preferable temperature range is 900–1250° C. When the composition of the metal powder is principally made from a cobalt based self-fluxing alloy, the acceptable temperature range is 850–1400° C., and the preferable temperature range is 900–1300° C. When the composition of the metal powder is principally made from a tungsten carbide based self-fluxing alloy, the acceptable temperature range is 850–1450° C., and the preferable temperature range is 900–1400° C.

When the above-mentioned sintering temperature is induced, the acceptable sintering time is 0.5–8 hours, but preferably it is 1–5 hours.

The preference is for a sintering atmosphere is that of a non-oxygen atmosphere. This atmospheric condition contributes to the reduction of the vacancy ratio for the metal sintering part and to an increase in wear resistance. The preferable atmospheric condition is (a) under the reduced pressure (vacuity), which is less than $1\times10^{-2}$ (more preferably, $1\times10^{-2}$–$1\times10^{-6}$ Torr), (b) in an inert gas atmosphere (such as, nitrogen gas or argon gas), which is 1–760 Torr, or (c) in hydrogen gas, which is 1–760 Torr.

The atmospheric condition can be changed during the sintering procedure. For example, at first the condition is one of pressure reduction (in vacuity), whose range is $1\times10^{-2}$–$1\times10^{-6}$ Torr. Then, the atmospheric condition can change into the above-mentioned inert gas during the process.

The sintering procedure under the above-mentioned conditions contributes to the additional reduction of the vacancy ratio; in other words, there is high density & high degree of hardness of the metal sintered part. Simultaneously, it results in rather precise dimensional accuracy, a more efficient sintering effect, and a shorter production time for the sintering process. The sintering operation is also safer. Subsequently, the productivity increases over-all.

The sintering may be conducted in two or more phases. For example, the first sintering process and the second sintering process, which are under different sintering conditions, can be conducted. In this case, the sintering temperature pursuant to the second sintering process can set higher than the temperature of the first sintering process. The foregoing results of the sintering effect substantially increase; then, the additional high density and hardness will be accomplished.

As described above, the density of green body (de-binding body) is uniform, so that the sintering process (particle growth) cures evenly when performing the sintering process. Therefore, the green body (de-binding part) shrinks evenly, and any sintering defects, such as deformation, cracking, and surface sink, are prevented. Simultaneously, the precise dimensional accuracy is achieved.

The subject metal sintered part can be applied not only as an adjunct to the power transmission component, which is illustrated in FIG. 1 and FIG. 2, but can also be utilizing for metal products and metal components in all industrial fields.

In this invention, the following processes may exist with optional purposes: a precedent process of the process [1A], a middle process between process [1A] and [3A], and a sequence process of the process [3A].

It is acceptable that the Vickers hardness factor Hv of the surface of the produced metal sintered part 1 from above-mentioned method, is more than value 500. However, a value of 600–850 is preferable. If the surface hardness value of the metal sintered part 1 is too low, the wear resistance is insufficient.

The mechanic strength, especially the tensile strength, is not limited. It can be relatively low. Specifically, 10–60 kg/mm$^2$ is acceptable.

The density of the metal sintered part 1 is not limited. As an implementation, using a nickel radical based alloy, more than 7.3 g/cm$^3$ is acceptable, and 7.4–7.7 g/cm$^3$ is preferable.

EMBODIMENT

Next, a specific embodiment of this invention is explained.

Embodiment 1

Metal powder, which is comprised of the nickel based self-fluxing alloy with an average diameter of 12 $\mu$m is prepared. The composition is as follows:

| | |
|---|---|
| C: | 0.897 wt % |
| Si: | 3.76 wt % |
| Mn: | 0.04 wt % |
| Cr: | 18.05 wt % |
| Mo: | 2.85 wt % |
| Cu: | 4.20 wt % |
| B: | 3.42 wt % |
| Fe: | 3.33 wt % |
| Ni: | Balance |

The composition of the binding material is as follows:

| | |
|---|---|
| Above-mentioned metal powder: | 94.5 wt % |
| Polystyrene: | 1.65 wt % |
| Ethylene - vinyl acetate copolymer: | 1.65 wt % |
| Paraffin: | 1.4 wt % |
| As plasticizer, | |
| Dibuthyl phthalate: | 0.8 wt % |

The metal power, the binding material and the plasticizer material are combined and mixed with a kneading machine under the 110° C. and 1 hour conditions.

Next, this feed stock is infused by the 'metal injection molding (MIM)' method using the injection molding machine. Then, a green body with a shape, which is indicated in FIG. 1 and FIG. 2, is obtained. The molding conditions at the injection molding are (a) mold temperature: 30° C., and (b) injection pressure: 110 kgf/cm$^2$.

The content amount of the metal powder in the green body is approximately 94.2 wt %. Next, the de-binding process is conducted for the subject green body using the de-binding furnace. The de-binding conditions are (a) under the reduced pressure ($1\times10^{-3}$ Torr), (b) 450° C., and (c) 1 hour.

Next, the sintering process is conducted for the subject de-binding part with the sintering furnace. Then, the metal sintered part is obtained. The sintering conditions were: (a) in argon gas atmosphere, (b) 1000° C., and (c) 3 hours duration of heating.

The dimensions of the obtained metal sintered part are as follows:

| | |
|---|---|
| Maximum external diameter of sprocket gear: | 45 mm |
| Maximum external diameter of ratchet gear: | 40 mm |
| Center opening diameter: | 8 mm |
| Thickness: | 3.1 mm |
| The other: | |
| Number of the juts in the periphery of the sprocket gear: (created @ 12° interval) | 30 |
| Number of the ratchet teeth in the periphery of the ratchet gear: (created @ 12° interval, 6° shift from the juts of the sprocket gear) | 30 |

Embodiment 2

Metal powder, which was comprised of the nickel based self-fluxing alloy with an average diameter of 15 μm is prepared. The metal sintered part is produced with the same procedure as with Embodiment 1, except the metal composition is varied. This composition is as follows:

| | |
|---|---|
| C: | 0.6 wt % |
| Si: | 4.00 wt % |
| Mn: | 0.04 wt % |

-continued

| | |
|---|---|
| Cr: | 13.04 wt % |
| Mo: | 0 wt % |
| Cu: | 0 wt % |
| B: | 3.48 wt % |
| Fe: | 3.50 wt % |
| Ni: | Balance |

The characteristics of the produced metal sintered parts (the power transmission component, which are illustrated in FIG. 1 and FIG. 2) for Embodiments 1 and 2 were researched. The results are indicated in the below-mentioned Table 2.

As illustrated in FIG. 2, the metal sintered parts for Embodiments 1 and 2 are confirmed to have the following characteristics: (a) high density (low vacancy rate), (b) high degree of hardness, (c) superior wear resistance, (d) precise dimensional accuracy, (e) no defects, such as crack or deformation. The metal sintered parts were over-all high quality.

As described above, this invention can offer a metal sintered part with a high degree of hardness and a superior wear resistance, and the production method is uncomplicated. Notably, it can be constructed with less numbers of components, causing the production cost to be moderate.

The dimensional accuracy is precise, and the sintering defects, such as cracking and the deformation, are not observed. The metal sintered part with high quality and high reliability is hereby offered.

The metal sintered part of this invention has a high degree of usability, and is preferable in application for the power transmission components.

Industrial Applications

As described above, the metal sintered part of this invention has a high degree of usability when integrated as a power transmission component. This invention is not confined to power transmissions, and it can be applied to metal products and metal components in all fields.

TABLE 1

| | | Composition [wt %] | | | | | | | |
|---|---|---|---|---|---|---|---|---|---|
| Type | Symbol | Ni | Cr | B | Si | C | Fe | Co | Other |
| A | (1) | Balance | 0–10 | 1.0–2.5 | 1.5–3.5 | <0.25 | <4 | <1 | Cu < 4<br>Mo < 4<br>Cu < 5 |
| | (2) | Balance | 9–11 | 1.5–2.5 | 2.0–3.5 | <0.5 | <4 | <1 | |
| | (3) | Balance | 10–15 | 2.0–3.0 | 3.0–4.5 | 0.4–0.7 | <5 | <1 | |
| | (4) | Balance | 12–17 | 2.5–4.0 | 3.5–5.0 | 0.4–0.9 | <5 | <1 | |
| | (5) | Balance | 15–20 | 3.0–4.5 | 2.0–5.0 | 0.5–1.1 | <5 | <1 | |
| B | (6) | 10–30 | 16–21 | 1.5–4.0 | 2.0–4.5 | <1.5 | <5 | Balance | Mo < 7<br>W < 10 |
| | (7) | 0–15 | 19–24 | 2.0–3.0 | 1.5–3.0 | <1.5 | <5 | Balance | W 4–15 |
| C | (8) | | | | WC: 20–80 Balance: (6) and/or (7) | | | | |
| | (9) | | | | WC: 20–80 Balance: (4) and/or (5) | | | | |

A: Nickel based self-fluxing alloy
B: Cobalt based self-fluxing alloy
C: Tungsten - carbide self-fluxing alloy

TABLE 2

| | Embodiment 1 | Embodiment 2 |
|---|---|---|
| Density [g/cm$^3$] | 7.6 | 7.65 |
| Relative density [%] | 99 | 98 |
| Vickers hardness Hv | approximately 650 | approximately 650 |
| Tensile strength [kg/mm$^2$] | approximately 20 | approximately 25 |
| Dimension accuracy* | ±0.08 mm | ±0.08 mm |
| Sintering defects | None | None |

* . . . Dimension error for ratchet gear with 40 mm external diameter.

What is claimed is:

1. A metal sintered part, wherein the metal sintered part is produced by de-binding and sintering a green body;

said green body includes a self-fluxing alloy with a content of 80–98 wt % and a binding material; and the above-mentioned self-fluxing alloy is comprised of a nickel-based alloy, wherein said green body is sintered at a temperature of 850–1350° C.

2. The metal sintered part of claim 1, wherein the above-mentioned green body is produced by using a metal injection molding method.

3. The metal sintered part of claim 1, wherein the Vickers hardness Hv on the surface of the above-mentioned metal sintered part is more than value 500.

4. The metal sintered part of claim 1, wherein the tensile strength of the above-mentioned metal sintered part is between 10 and 60 kg/mm$^2$.

5. The metal sintered part of claim 1, wherein the metal sintered part has a portion designed for high wear durability.

6. The metal sintered part of claim 1, wherein the metal sintered part is a component within a power transmission.

7. The metal sintered part of claim 1, wherein the above-mentioned metal sintered part engages a first driveline (sprocket gear) and a second driveline (ratchet gear) in the power transmission component.

8. A production method of a metal sintered part, wherein the production method comprises:

producing a green body which includes a self-fluxing alloy with a content of 80–98 wt % and a binding material, wherein the self-fluxing alloy is comprised of a nickel-based alloy;

conducting a de-binding treatment to the obtained green body; and sintering the obtained de-binding part at a temperature of 850–1350° C. to produce a metal sintered part.

9. The production method of the metal sintered part of claim 8, wherein the production of the above-mentioned green body is conducted by using the metal injection molding method.

* * * * *

UNITED STATES PATENT AND TRADEMARK OFFICE

CERTIFICATE OF CORRECTION

PATENT NO. : 6,428,595 B1
DATED : August 6, 2002
INVENTOR(S) : Junichi Hayashi et al.

It is certified that error appears in the above-identified patent and that said Letters Patent is hereby corrected as shown below:

Title page,
Item [54], "SINTERE" should be -- SINTERED --.
Delete "THEREOF".

Column 1,
Line 1, "SINTERE" should be -- SINTERED --.
Line 2, delete "THEREOF".

Column 4,
Line 38, "based" should be -- base --.

Column 5,
Line 15, "&" should be -- and --.
Line 16, "&" should be -- and --.
Line 36, "&" should be -- and --.
Line 38, "&" should be -- and --.

Column 6,
Line 52, delete "is".
Lines 65-66, "$1x10^{-}2$-$1x10^{-6}$" should be -- $1x10^{-2}$-$1x10^{-6}$ --.

Column 7,
Line 3, "&" should be -- and --.

Signed and Sealed this

Twenty-fourth Day of December, 2002

JAMES E. ROGAN
*Director of the United States Patent and Trademark Office*